US006435583B1

(12) United States Patent
Reist

(10) Patent No.: US 6,435,583 B1
(45) Date of Patent: Aug. 20, 2002

(54) GRIPPER FOR FLAT OBJECTS

(75) Inventor: Walter Reist, Hinwil (CH)

(73) Assignee: Ferag AG, Hinwil (CH)

( * ) Notice: Subject to any disclaimer, the term of this patent is extended or adjusted under 35 U.S.C. 154(b) by 0 days.

(21) Appl. No.: 09/555,315

(22) PCT Filed: Sep. 21, 1998

(86) PCT No.: PCT/CH98/00405

§ 371 (c)(1),
(2), (4) Date: Sep. 22, 2000

(87) PCT Pub. No.: WO99/30996

PCT Pub. Date: Jun. 24, 1999

(30) Foreign Application Priority Data

Dec. 17, 1997 (CH) ..... 2900/97

(51) Int. Cl.[7] ..... B65H 29/02; B66C 1/48

(52) U.S. Cl. ..... 294/116; 271/204; 294/100

(58) Field of Search ..... 294/16, 33, 87.1, 294/87.12, 94, 95, 99.1, 100, 104, 106, 115, 116, 132; 198/803.7–803.9; 271/204, 277

(56) References Cited

U.S. PATENT DOCUMENTS

| | | | | | |
|---|---|---|---|---|---|
| 515,162 | A | * | 2/1894 | Parson | 294/100 X |
| 1,184,372 | A | * | 5/1916 | Nalley | 294/87.12 |
| 1,375,580 | A | * | 4/1921 | Fisher | 294/33 |
| 2,177,595 | A | * | 10/1939 | Freed | 294/87.12 |
| 2,336,527 | A | * | 12/1943 | Bullington | 294/115 |
| 2,792,253 | A | * | 5/1957 | Bliss | 294/100 |
| 4,681,213 | A | * | 7/1987 | Winiasz | 294/104 X |
| 4,721,296 | A | | 1/1988 | Mowry | 270/55 |
| 4,779,717 | A | | 10/1988 | Eberle | 198/803.8 |
| 5,328,017 | A | * | 7/1994 | Carlen | 271/204 X |
| 5,755,436 | A | | 5/1998 | Reist | 271/204 |

FOREIGN PATENT DOCUMENTS

| | | | | |
|---|---|---|---|---|
| DE | 1563730 | * | 4/1970 | 294/100 |
| DE | 3011837 | * | 10/1981 | 294/100 |

* cited by examiner

*Primary Examiner*—Johnny D. Cherry
(74) *Attorney, Agent, or Firm*—Brinks Hofer Gilson & Lione

(57) ABSTRACT

Gripper for holding flat objects (21), more particularly flexible objects such as single or multiple sheet printing objects, comprising two gripper limbs (11, 12) that can pivot in relation to each other and exert a clamping force on the object held (21) in a closed position and an actuating device engaging at least in one of the gripper limbs (11, 12) to produce a relative pivoting movement of both gripper limbs (11, 12). The actuating device can be displaced from an open to a closed position of the gripper limbs (11, 12) and has at least one sliding part (18) whose translational movement produces a force on at least one gripper limb (11, 12) either in the direction of the open position or in the direction of the closed position.

15 Claims, 5 Drawing Sheets

GRIPPER FOR FLAT OBJECTS

Figure 1A:
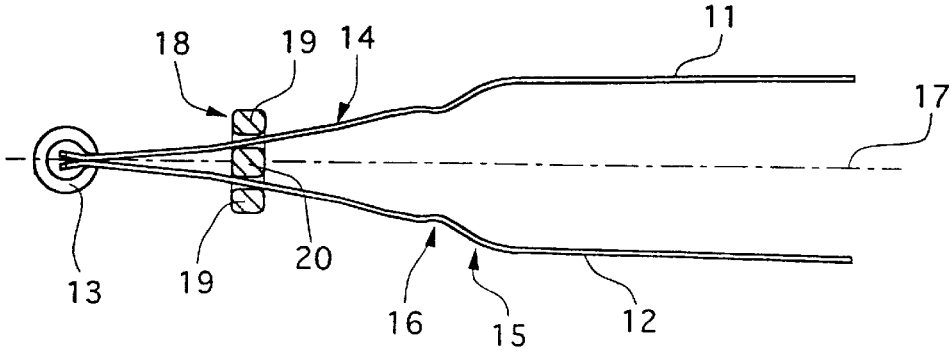

The invention relates to a gripper for retaining sheet-like articles, in particular flexible articles such as printed products containing one or more sheets, having two gripper legs which can be pivoted relative to one another and, in a closed position, subject the retained article to a clamping action, and having an actuating device which acts on at least one of the gripper legs in order to produce a pivoting movement of the two gripper legs relative to one another, it being possible for the actuating device to be moved in a translatory manner for the changeover between an open position and the closed position of the gripper legs.

Such grippers are used, in particular, in conveying apparatus for the individual transportation of articles. For example, these articles may be various printer products which are retained in a hanging position by grippers guided along a transporting path.

A gripper of the type mentioned in the introduction is known from European Patent Application EP 0 767 125 A1. The gripper disclosed therein has two gripper legs which are retained in the closed position by a closing device with two clamping bodies. Pivoting or translatory movement of the closing device allows the gripper legs to be released and to pivot to their open position.

This known gripper has the disadvantage that the gripper legs, which can be pivoted in a freely movable manner, actually only pivot into a definite open position when an additional element, for example a compression spring which subjects the clamp jaws to a continuous spreading force, is provided.

It is an object of the invention to provide a gripper of the type mentioned in the introduction which, along with a straightforward mechanical construction, can execute a precise changeover between the closed position and open position. The gripper is intended to make it possible for the article to be retained in a secure manner and for the opening and closing movements to be controlled in a straightforward manner.

The object is achieved according to the invention in that the actuating device has at least one sliding part, it being possible, by way of the translatory movement of the latter, for at least one gripper leg to be subjected to force either in the direction of the open position or in the direction of the closed position.

Translatory movement of the sliding part in the context of the invention is to be understood as any movement relative to the gripper legs along a straight line or curve.

The at least one gripper leg may thus be subjected to force by means of the sliding part. By corresponding translatory movement of the sliding part, it is possible, for the active control both of the closing movement and of the opening movement of the gripper leg, for the direction and magnitude of the force to be determined directly without further auxiliary means such as additional mechanical elements being necessary for this purpose.

The possibility of actively moving the gripper legs in two opposite directions allows controlled closing and opening movements, for example in order to allow an article, with simultaneous movement of the gripper, to drop at a precise time and location.

Since, in the case of the gripper according to the invention, an opening and closing movement can be produced by a single sliding part, of which the structural configuration is not subject to any stringent requirements, it is possible for the gripper to be designed easily and cost-effectively in a manner which particularly reduces weight, the materials used and the amount of space required.

In comparison with known grippers in which spreading stress which acts permanently on the legs is provided in order to force the legs passively to open, the gripper according to the invention has the advantage that the legs may be actively caused to execute any desired pivoting movement and, at the same time, may be mounted in a freely pivotable manner without such spreading stress, with the result that, during the active pivoting movement of the legs, there is no need for any additional force to be applied in order to overcome such spreading stress.

Finally, the forces which are necessary for the translatory movement of the sliding part may advantageously be transmitted to the sliding part symmetrically in relation to the axes of symmetry of the gripper, with the result that there is no need to take any particular measures in order to stabilize the gripper against possible tilting movements.

In a preferred embodiment, the sliding part of the gripper has a spreading element which, in order to cause an opening movement or stabilize at least one gripper leg, can subject the latter to a spreading force. In particular, the spreading element may be arranged between the two gripper legs and may subject the two gripper legs simultaneously to the spreading force.

It is also preferred if the sliding part has one or two closing elements by means of which a respectively associated gripper leg can be subjected to a closing force in order to cause said gripper leg to execute a closing movement or to stabilize the same in a certain position.

The gripper legs may have at least one latching depression in which the respectively associated closing element can be latched in a certain opening position of the gripper legs, for example the closed position. This makes it possible to maintain this position without the respective gripper leg having to be actively subjected to force, for example, by being continuously subjected to the action of force or by translatory movement of the sliding part.

It is preferred if that section of the spreading element or of the closing element which is directed toward a gripper leg is designed as a flat surface. In this case, force is transmitted particularly homogeneously from the sliding part to a gripper leg, which is likewise designed as a flat surface. The force-transmission surface area of the closing element preferably extends along the entire width of the associated gripper leg. The forcetransmission surface area of the spreading element may be designed as at least one nose which extends along merely the border of the respectively associated gripper leg.

It has proven to be particularly effective and straightforward for the gripper leg to be subjected to the action of force by the sliding part and the guidance of the sliding part if the sliding part is moved along or parallel to an axis or plane in relation to which the two gripper legs are arranged symmetrically, in particular in their closed position. This is because, in this case, transverse forces are avoided, with the result that mechanical configuration of the gripper and of the sliding-part guide means is also simplified.

In a preferred embodiment of the gripper, the actuating device has precisely one sliding part with essentially two openings, through which in each case one gripper leg runs. This means that the two gripper legs can be simultaneously subjected to the action of force, and moved, solely by the translatory movement of the single sliding part.

In a further embodiment of the invention, it is possible for the actuating device to have precisely two sliding parts with in each case one opening, in each case one gripper leg running through each opening. In this case, the two sliding parts and thus the respective opening position of the corresponding legs can be respectively actuated and influenced with one another or independently of one another. Preferably provided in this embodiment is a guide means which ensures translatory movement of the two sliding parts along mutually parallel paths.

Finally, in a further embodiment of the gripper according to the invention, it is possible for the actuating device to have precisely one sliding part with an opening, through which merely one of the two gripper legs runs. If it is just this gripper leg which is suspended pivotably in a freely movable manner, and the other gripper leg assumes an essentially fixed position, it is possible for the sliding part and thus also the pivotable gripper leg to be actuated between the closed position and the open position of the gripper, with the simplified mechanical configuration.

It is possible, in the case of the abovementioned embodiments of the invention, for the two gripper legs to be designed as separate parts or in one piece. For the purpose of securely gripping and retaining sheet-like articles, it is possible for the gripper legs to be designed as gripper jaws in the form of a flat surface or of a flat-surface outline, the flat-surface sides of the two gripper jaws being directed essentially toward one another.

In particular in the case of a flat-surface configuration of the gripper legs as gripper jaws, it is advantageous if the abovementioned openings provided in the sliding part or parts are of slit-like design, and, as appropriate, run essentially parallel to one another. In this case, it is possible for the respective sliding part to butt closely against the corresponding gripper leg along a considerable length. This makes possible a particularly effective, homogeneous and quick force fit between the sliding part and the gripper leg.

In the case of the gripper according to the invention, the sliding part may enclose a gripper leg in the form of a ring. Alternatively, two mutually opposite sides of a gripper leg may also be subjected to the action of force by the sliding part in that the sliding part has an essentially U-shaped cross section and the gripper leg is arranged between the two U-legs of the sliding part. In this context, it is also possible to have an indent which is open on one side as one of the abovedescribed openings.

The two gripper legs may each be arranged in a freely movable manner, with the result that they may be pivoted independently of one another in each case without any substantial opposing force. For example, they may be mounted on a common pivot pin or on a dedicated pivot pin in each case. Alternatively, the two legs may also be fastened with one another such that, without the external action of force, they assume a defined rest position relative to one another which corresponds, for example, to the open position, the closed position or some other position.

The translatory movement of the sliding part may be controlled and/or produced in a known manner, for example by the provision, on one or both ends of the sliding part, of guide rollers which, during movement of the gripper, run along opening or closing guides. It is also possible for the gripper according to the invention to be equipped in a known manner with a suspension device for fastening on a transporting path.

The invention also covers a conveying apparatus which has a multiplicity of the grippers according to the invention for the individual transportation of articles.

Further preferred embodiments of the invention are described in the subclaims.

Figure 2A:
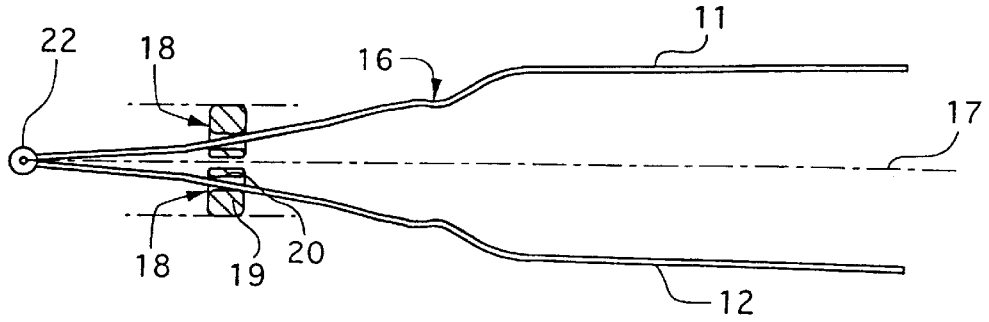
Figure 2B:
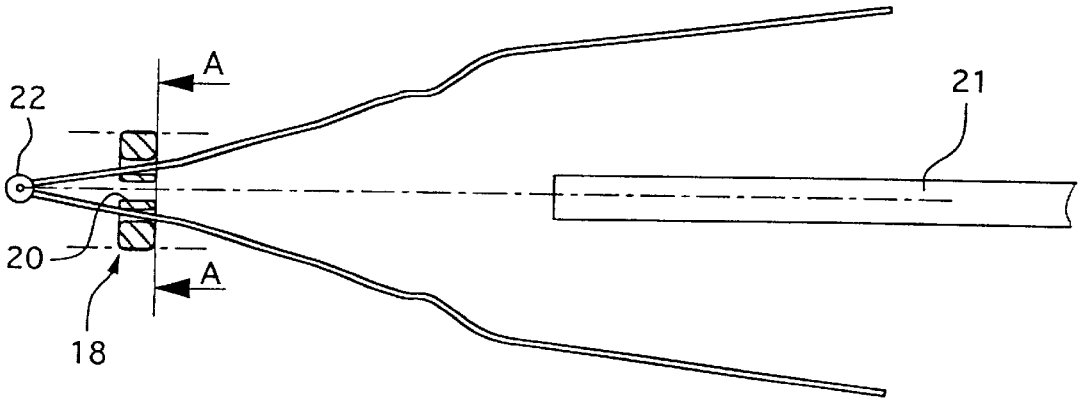
Figure 2C:
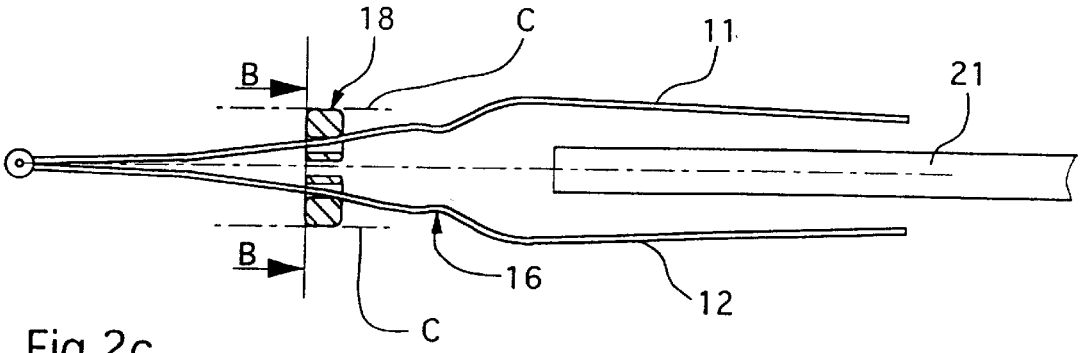
Figure 2D:
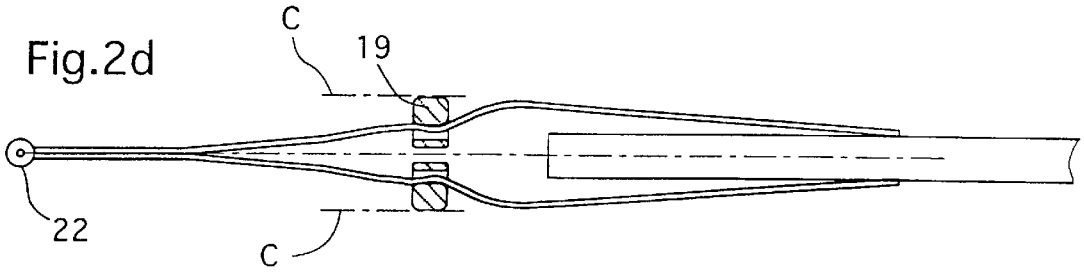
Figure 2E:
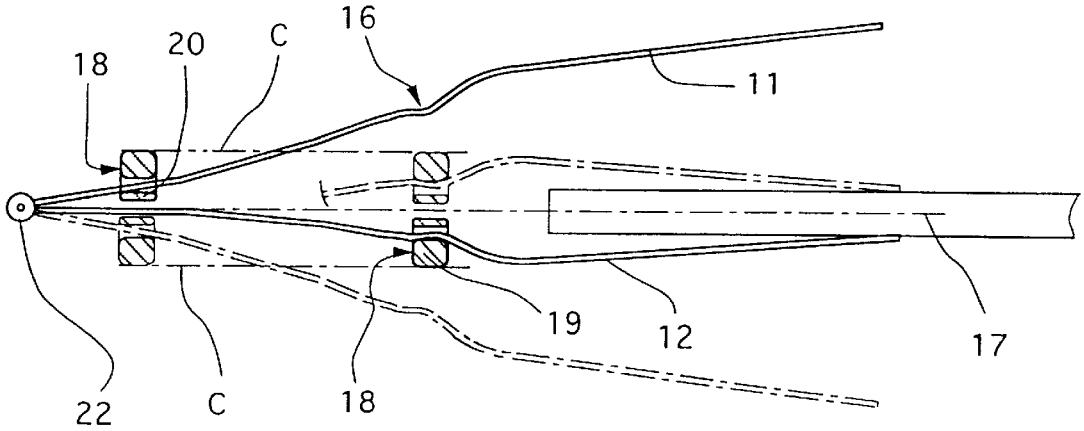
Figure 2F:
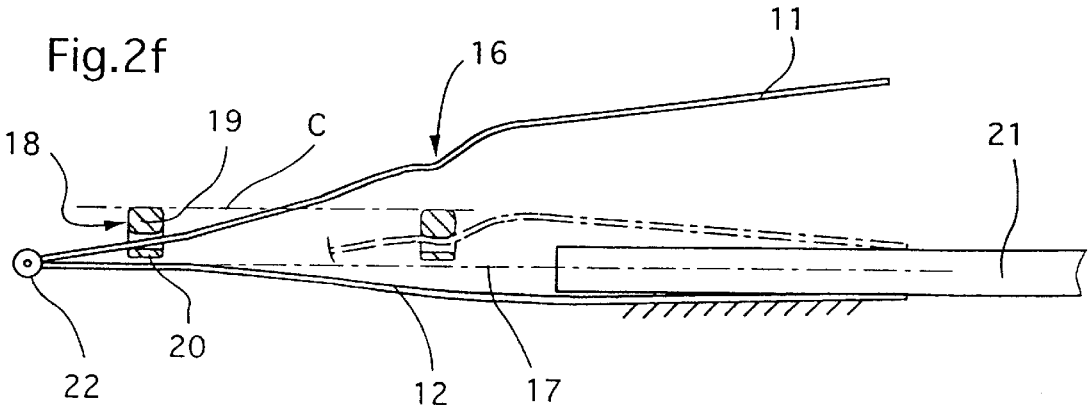
Figure 3:
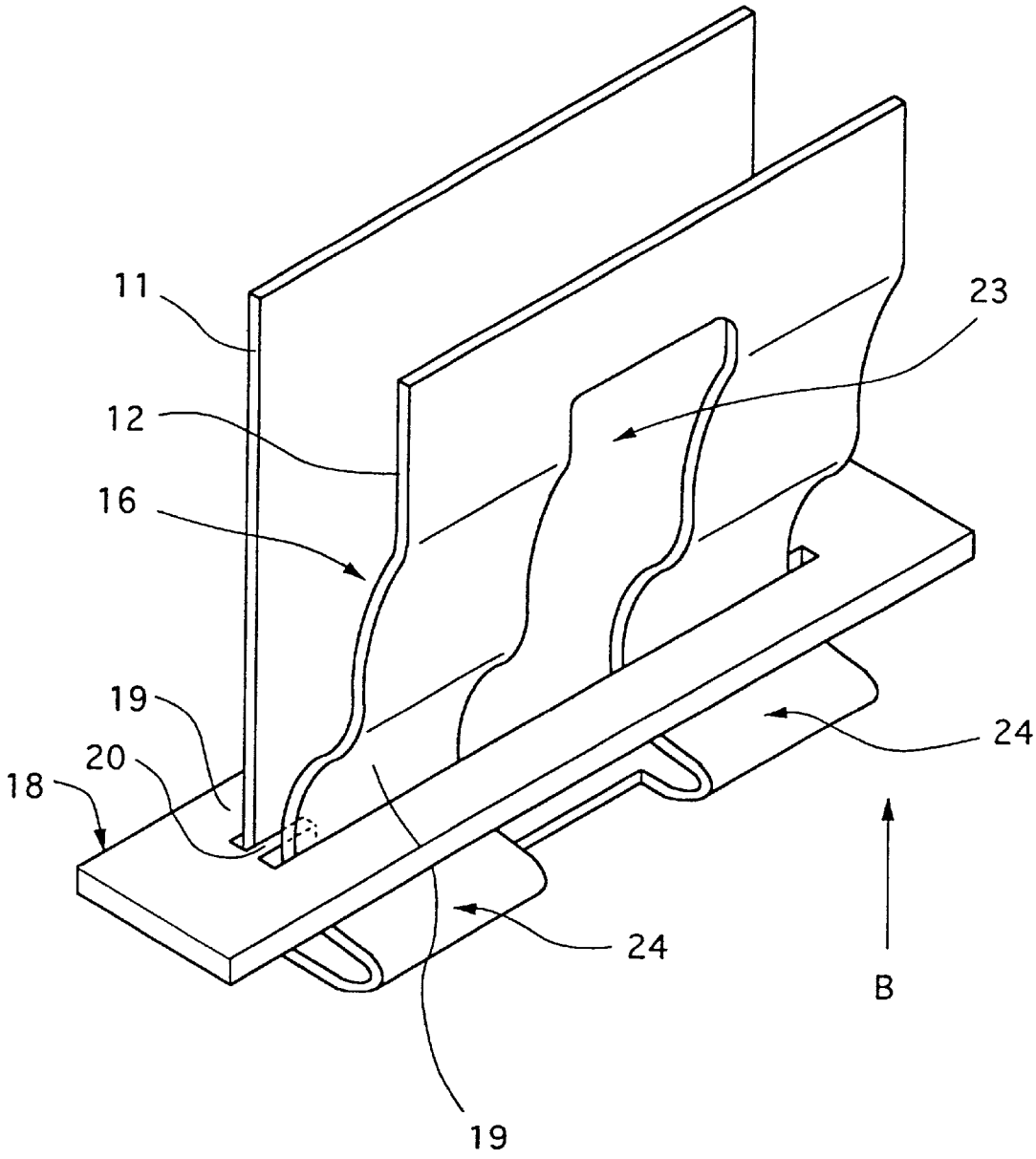

The invention is described hereinbelow, by way of exemplary embodiments, with reference to the drawings, in which:

FIGS. 1*a, b, c, d* show cross-sectional views of an embodiment of the gripper according to the invention with a single sliding part, the two gripper legs being shown in a stress-relieved position, in an open position, during closing movement and in a closed position, FIGS. 2*a, b, c, d, e* show cross-sectional views of a further embodiment of the gripper according to the invention with two separate sliding parts, the two gripper legs being shown in an intermediate position, in an open position, during closing movement, in a closed position and in a single-sided open position, FIG. 2*f* shows a cross-sectional view of a further embodiment of the gripper according to the invention with a single sliding part acting merely on one gripper leg, said gripper leg being shown in an open position, and FIG. 3 shows a perspective view of a further embodiment of the gripper according to the invention with a single sliding part.

Figure 4:
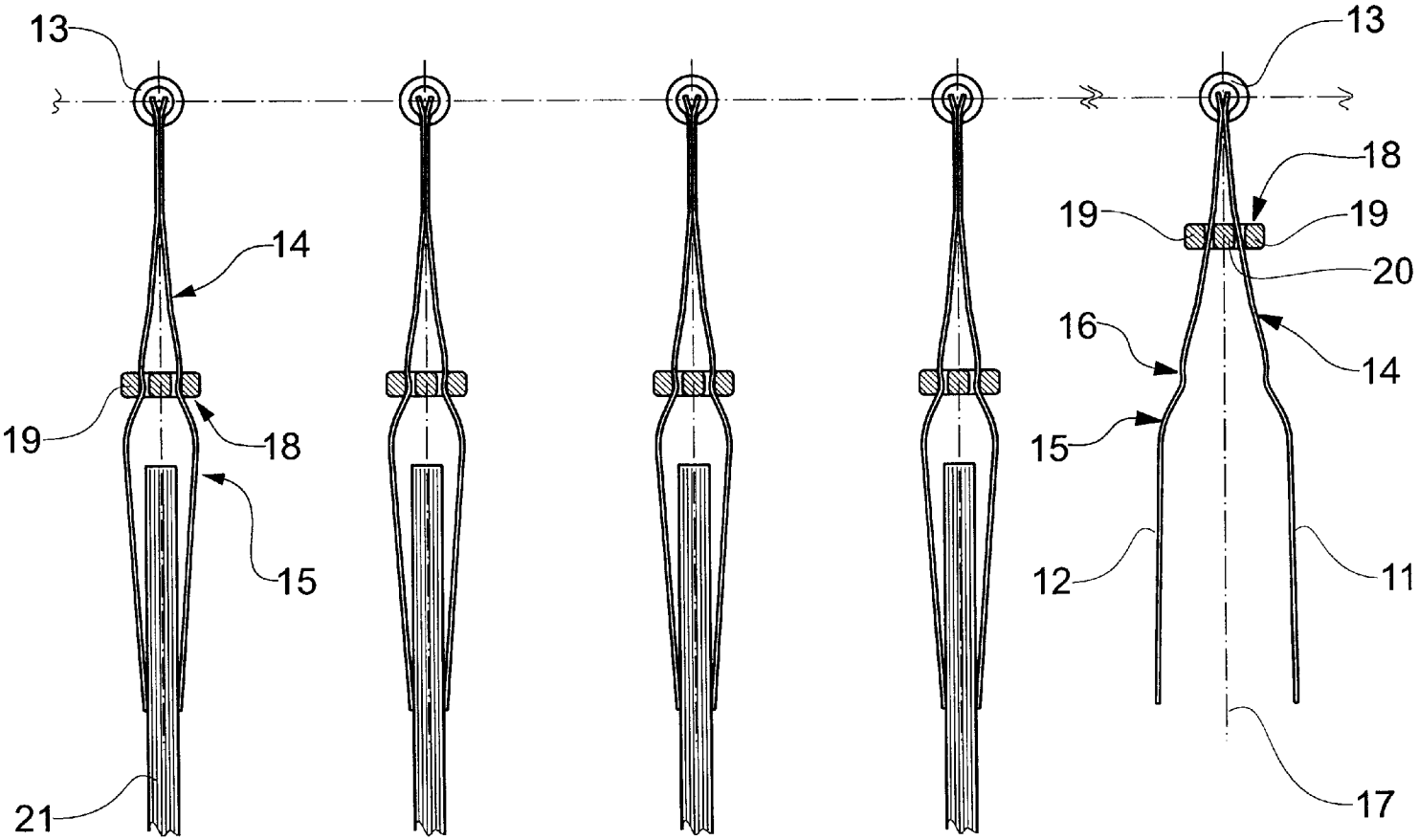

FIG. 4 shows a plurality og grippers.

FIGS. 1*a, b, c, d* show a gripper according to the invention with two gripper legs 11, 12 made of elastic material, for example plastic, spring steel or the like. The legs 11, 12 are wedged with one another along a split-tube sleeve 13. In the cross-sectional view illustrated, they run convexly, in relation to the respectively other leg 12 or 11, in a region 14 in the vicinity of the split-tube sleeve 13 and run concavely in a region 15 adjacent to their respective free end. Between these regions 14, 15 the legs 11, 12 have a latching depression 16 which is oriented in the direction of the respectively other leg 12 or 11.

The two gripper legs 11, 12 and slit-tube sleeve 13 each extend in a direction perpendicular to the plane of the paper, with the result that the legs 11, 12 assume a flat-surface form and the split-tube sleeve 13 assumes an elongate form. In this case, the two gripper legs 11, 12 are arranged with their regions 14, 16, 15 in a mirror-symmetrical manner with respect to one another in relation to an angle-bisecting plane 17 likewise extending perpendicularly to the plane of the paper.

The gripper illustrated in FIGS. 1*a* to 1*d* has a single sliding part 18 with two closing elements 19 and with a spreading element 20, which are spaced apart from one another essentially along a line such that the two gripper legs 11, 12 are located in each case within the free space between the spreading element 20 and one of the two closing elements 19. The elements 19, 20 each have the cross section of a rectangle with rounded corners.

The closing elements 19 each extend, as an elongate, continuous crosspiece, perpendicularly to the plane of the paper, along the entire width of the two a legs 11, 12 and beyond the same. The spreading element 20 has two noses which each project between the two gripper legs 11, 12 from the outside in a direction perpendicular to the plane of the paper. At their outer longitudinal ends i.e. in each case adjacent to the two side borders of the legs 11, 12, the three elements 19, 20 are fixed to one another, with the result that an opening is bounded in each case by a closing element 19 with the pair of noses 20.

Figure 1B:
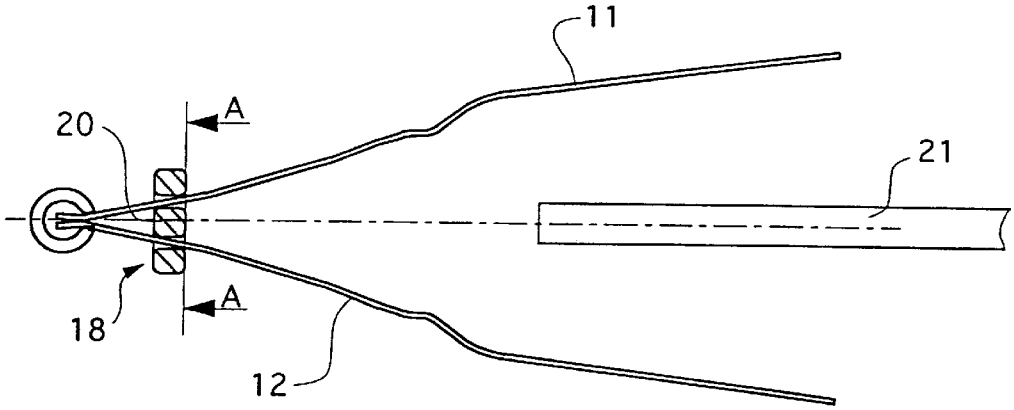
Figure 1C:
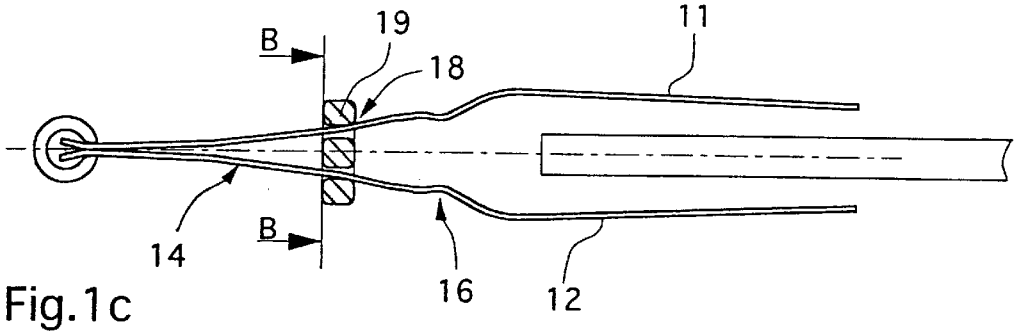
Figure 1D:
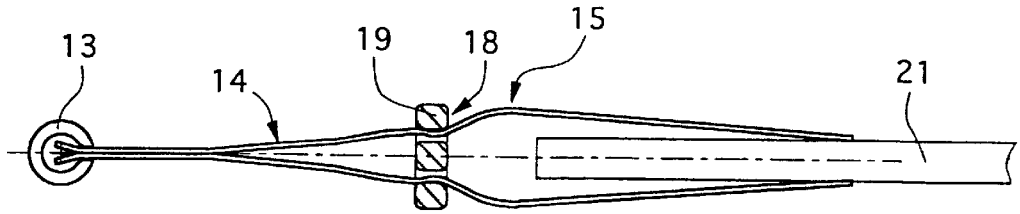

FIGS. 1*b* to 1*d* also show, on the plane of symmetry 17, a sheet-like article 21 which projects into the gripper along part of the leg region 15.

The gripper illustrated in FIGS. 1*a* to 1*d* serves for gripping, retaining and releasing an article 21. The gripper may be arranged on a conveying apparatus by means of which it can be transported in a desired direction in order to perform these functions, or as these functions are being performed, or can be positioned for receiving products, i.e. moved into preferred positions and aligned.

FIG. 1*a* shows a stress-relieved position of the gripper, in which the gripper legs 11, 12 enclose an opening angle which is predetermined by the joint clamping of the legs 11, 12. The sliding part 18 is located in a neutral position, in which neither the spreading element 20 nor the closing elements 19 subject the gripper legs 11, 12 to force.

In the illustration according to FIG. 1*b*, the legs 11, 12 are located in an open position, in which the article 21 can be fed to the gripper, or can leave the same, in a particularly straightforward manner. This open position is reached by the sliding part 18 executing a translatory movement along the plane of symmetry 17 in the direction A of the split-tube sleeve 13. This causes the inner sides of the two gripper legs 11, 12 to be subjected to the action of the spreading element 20, with the result that the legs 11, 12 are caused to execute an opening movement.

FIG. 1*c* shows a translatory movement of the sliding part 18 in the direction B of the free ends of the two legs 11, 12. In this case, the two closing elements 19 act on the outer side of the region 14 of the gripper legs 11, 12 which is directed toward them in each case, and subject the same to a closing force. As a result, the two legs 11, 12 execute a closing movement in which they are moved toward one another.

FIG. 1*d* shows the closed position of the two gripper legs 11, 12, achieved following completion of the closing movement illustrated in FIG. 1*c*, for retaining the article 21. The two closing elements 19 are latched in the latching depression 16 of the gripper legs 11, 12. The opposing forces necessary for the latching of the sliding part 18 result from the two legs 11, 12 butting, on the one hand, against one another along their regions 14 and, on the other, against the article 21 by way of their regions 15.

FIGS. 2*a* to 2*e* illustrate a further embodiment of the gripper according to the invention, the same or similar parts in each case being given the same designations as in FIGS. 1*a* to 1*d*. In particular, the gripper illustrated in FIGS. 2*a* to 2*e* has two gripper legs 11, 12 with in each case one latching depression 16 and two sliding parts 18 with in each case a single closing element 19 and element 20.

The gripper legs 11, 12 are connected to one another in a freely pivotable manner at one end in each case via a hinge articulation 22. The gripper arrangement as a whole is symmetrical in relation to the angle bisector 17 of the opening angle enclosed by the two legs 11, 12.

The closing elements 19 and spreading elements 20 of the gripper illustrated in FIGS. 2*a* to 2*e* each have a cross section in the form of a rectangle with rounded corners. The closing element 19 and the spreading element 20 of a sliding part 18 are spaced apart from one another and are connected to one another at at least one end located in direction perpendicular to the plane of the paper, with the result that they form a U or a ring. In each case one gripper leg 11, 12 is guided between these two U-legs or ring sections 19, of a sliding part 18.

FIG. 2*a* shows an intermediate position of the two gripper legs 11, 12. By virtue of a translatory movement of the sliding parts 18 along the angle bisector 17 in the direction A of the hinge articulation 22, said movement being shown in FIG. 2*b*, the gripper legs 11, 12 are subjected to force in each case by the two spreading elements 20, with the result that said legs are actively caused to execute an opening movement in the direction of an open position.

By virtue of a following translatory movement of the sliding parts 18 in the direction B of the free ends of the gripper legs 11, 12, said movement being illustrated in FIG. 2*c*, the closing elements 19 of the sliding parts 18 subject the two legs 11, 12 to force, with the result that said legs are moved toward one another.

With continued translatory movement of the sliding parts 18 in the direction B, the free ends of the gripper legs 11, 12 strike against the article 21. On account of this contact, of the common point of suspension of the legs 11, 12 on the hinge articulation 22 and of the essentially concavely curved construction of the legs 21, 22 in each case, further movement of the sliding parts 18 along the axis of symmetry 17 effects an even more pronounced clamping force of the free ends of the legs 11, 12 on the retained article 21 and a deformation of the two gripper legs 11, 12.

It is an advantage of that embodiment of the invention which is illustrated in FIGS. 2*a* to 2*e* (and also in FIG. 2*f*) that it is only at this point in time, for the translatory movement of the sliding parts 18 and thus the deformation of the gripper legs 11, 12, that any significant force has to be supplied.

If the sliding parts 18 are moved as far as the respective latching depression 16, they latch therein, and the corresponding gripper leg 11, 12 is located 13 as is shown in FIG. 2*d* in the closed position.

The translatory movement of the two sliding parts 18 which is described in conjunction with FIGS. 2*a* to 2*d* takes place parallel to the angle bisector 17 and, in particular, along the same straight line C in each case for each sliding part 18. A rectilinear guide means (not illustrated in the figures) is provided for this purpose.

A further advantage of the gripper illustrated in FIGS. 2*a* to 2*e* is that the two sliding parts 18 and thus the gripper legs 11, 12, which are subjected to the action of force by the same in each case, can be moved independently of one another, which allows more flexible use of the gripper. For example, one 12 of the legs may be left in the closed position, while, in order to release an article 21, merely the other leg 11 executes an opening movement. Such a single-sided open position of the gripper is shown in FIG. 2*e*.

It is also the case that the independent translatory movement of the two gripper legs 11, 12 takes place along the guide path C in each case by way of the guide means.

The gripper illustrated in FIGS. 2*a* to 2*e* is designed as a gripper clasp which reduces weight, the materials used and the amount of space required and in the case of which the gripper legs 11, 12 have an elongate, bar-like form, are made of a flexible metal and are merely of a narrow width in the direction perpendicular to the plane of the paper.

FIG. 2*f* shows a further embodiment of the gripper according to the invention. This gripper has two legs 11, 12, of which one 12 —as is indicated by the shading —assumes an essentially fixed position, and the other 11 can be pivoted freely about a hinge articulation 22 in relation to the fixed leg 12. A single ring-form sliding part 18 engages around the pivotable leg 11 by way of a closing element 19 and a spreading element 20.

A guide means (not illustrated) limits the movement of the sliding part 18 to a straight line C running parallel to the center plane 17 of the gripper. The position of the fixed leg 12 is fixed in relation to the guide path C by a fixing means (not illustrated).

A translatory movement of the sliding part 18 Ialong the straight line C causes the pivotable leg 11 to open or close in order respectively to release or grip a product 21. It is only the pivotable leg 11 which has a latching depression 16, by means of which the sliding part 18 —as is illustrated by dashed lines in FIG. 2*f* —can latch in the closed position of the pivotable leg 11 or of the gripper.

FIG. 3 shows a further embodiment of a gripper according to the invention, parts which are identical or similar to those in the embodiments described above being given the same designations in each case.

The gripper has a flat-surface punched part which is made of sheet metal and is bent so as to form two gripper legs 11, 12 which are essentially parallel to one another in the stress-free state. One of the two legs 11 is formed as a rectangular, planar section of the sheet-metal punched part. The other gripper leg 12 has an elongate punched-out section 23, with the result that this leg 12 is in the form of a flat-surface clip. This leg 12 is deformed such that it has essentially concave curvature, in relation to the opposite leg 11, with a latching depression 16 located therein. Along the section 24 of the sheet-metal punched part, said section connecting the legs 11, 12, the material of the sheet-metal punched part is thinner.

FIG. 3 also illustrates a sliding part 18 with two slit-like openings adjacent to one another. The openings are separated off from one another at their longitudinal ends by two noses 20. Each of the two gripper legs 11, 12 is guided through one of the two openings, with the result that the pair of noses 20 acts as a spreading element. Those two sections of the sliding part 18 which extend along the width of the legs 11, 12, i.e. along the longitudinal direction of the openings, form in each case a crosspiece 19 which wo 99/309960 _/CH98/00405 acts as a closing element.

The position of the sliding part 18 between the two legs 11, 12 which is illustrated in FIG. 3 causes said legs to be spread apart by means of the spreading element 20. A translatory movement of the sliding part 18 in the direction B results in the two gripper legs 11, 12 being gradually subjected to the action of force by the two closing elements 19 and thus being caused to execute a closing movement until such time as they strike against one another at their respective free ends. If the sliding part 18 is moved further in the direction B, into the latching depression 16, the two gripper legs 11, 12 remain fixed in the closed position without any further force having to be applied to the sliding part 18.

The single-piece construction of the two gripper legs 11, 12 as a sheet-metal punched part allows the gripper to be produced in a particularly straightforward manner. On account of the punched-out section 23 and on account of the configuration of the sections 24 with merely a thinner layer of material, it is advantageously possible for the sliding part 18 to be moved in a translatory manner, and thus the two gripper legs 11, 12 to be caused to pivot relative to one another, without any significant force being applied.

Of course, the invention also covers all embodiments of a gripper which have any desired combination of different features of the grippers illustrated in FIGS. 1*a* to 1*d*, 2*a* to 2*f* and 3, in particular the features which involve a flat-surface, bar-like or clip-like configuration of a gripper leg, the use of a single sliding part or of two independent sliding parts, a freely pivotable or fixed connection of the two gripper legs to one another, a single-piece or separate construction of the gripper legs, and the materials used in each case. Moreover, the gripper according to the invention can be used for any desired conveying tasks and for any types of products and articles.

What is claimied is:

1. A gripper for retaining sheet-like articles (21) comprising two gripper legs (11, 12), each gripper leg (11, 12) having a substantially flat inner side facing the other gripper leg (11, 12), the gripper legs (11, 12) being mounted to pivot relative to one another such that the grippers legs move in a direction extending transversely to said flat inner sides to assume a closed position and an open position, wherein, in said closed position, the gripper legs (11, 12) are adapted to clamp a sheet-like article (21) with both of said flat inner sides contacting said sheet-like article, an actuating device acting on at least one of the gripper legs (11, 12) to produce a pivoting movement of the two gripper legs (11, 12) relative to one another, said actuating device being movable back and forth in a translatory manner for the changeover between said open position and said closed position of the gripper legs (11, 12)_and having at least one sliding part (18) which is movable back and forth in a translatory manner when the actuating device is moved back and forth in a translatory manner and which acts on said at least at least one gripper leg (11, 12) to subject the latter to a force in a direction toward said open position during a translatory movement of the sliding part (18) in one direction (A) and in a direction toward said closed position during a translatory movement of the sliding part (18) in the opposite direction (B).

2. A gripper according to claim 1, characterized in that the sliding part has a spreading element (20) by means of which, in order to produce an opening movement of at least of one gripper leg (11, 12), a flat inner side of said gripper leg (11, 12) which is directed toward the respectively other gripper leg (12, 11), can be subjected to the action of force.

3. A gripper according to either of claims 1 or 2, characterized in that the sliding part (18) has at least one closing element (19) by means of which, in order to produce a closing movement of an associated gripper leg (11, 12), the side opposite to said flat inner side of this gripper leg (11, 12) which opposite side is directed away from the respectively other gripper leg (12, 11) can be subjected to the action of force.

4. A gripper according to claim 3, characterized in that at least one of the two gripper legs (11, 12) has a latching depression (16) in which the closing element (19) assigned to the gripper leg (11, 12) can be latched in the closed position.

5. A gripper according to claim 2, characterized in that said sliding part has at least one closing element (19) by which a closing movement of an associated gripper leg (11, 12) is produced and said two gripper legs mounted to pivot relative to one another pivot about a pivot axis and the side of the spreading element (20) and the closing element (19) which is directed toward a gripper leg (11, 12) is designed as an elongate flat surface which extends at least partially along the width of the gripper leg (11, 12) and parallel to the pivot axis of the gripper leg (11, 12).

6. A gripper according to claim 5, characterized in that the elongate flat surface is designed as a continuous crosspiece (19) which extends essentially along the entire width of the associated gripper leg (11, 12).

7. A gripper according to claim 1 or 2, characterized in that the gripper is symmetrical about the angle bisector (17) of the angle between the grippers legs when the gripper legs are in their open position and said sliding part can be moved in a translatory manner parallel to the angle bisector (17) of the angle formed by the two gripper legs (11, 12) in the closed position of the latter.

8. A gripper acco rding to claim 1 or 2, characterized in that the actuating device has one sliding part (18) with two openings, one gripper leg being guided through one opening and the other gripper leg being guidedjthrough the other open i ing.

9. Gripper according to claim 1 or 2, characterized in that the actuating device has precisely two sliding parts (18) with in each case one opening, through which in each case one gripper leg (11, 12) is guided, it being possible for the two sliding parts (18) to be actuated, in particular, independently of one another.

10. Gripper according to claim 1 or 2, characterized in that the actuating device has precisely one sliding part (18) with an opening, through which one of the two gripper legs (11, 12) is guided, it being possible for, in particular, just that gripper leg (11, 12) which is guided through the opening of the sliding part (18) to be pivoted.

11. A gripper according to claim 1 or 2, characterized in that the two gripper legs (11, 12) are wedged together on a split-tube sleeve (13).

12. A conveying a pparatus which is in tended for transporting articles (21), said conveying apparatus having a multiplicity of grippers, said grippers being of the type comprising:

two gripper legs (11, 12), each gripper leg (11, 12) having a substantially flat inner side facing the other gripper leg (11, 12), the gripper legs (11, 12) being mounted to pivot relative to one another such that the grippers legs move in a direction extending transversely to said flat inner sides to assume a closed position and an open position, wherein, in said closed position, the gripper legs (11, 12) are adapted to clamp a sheet-like article (21) with both of said flat inner sides contacting said sheet-like article, an actuating device acting on at least one of the gripper legs (11, 12) to produce a pivoting movement of the two gripper legs (11, 12) relative to one another, said actuating device being movable back and forth in a translatory manner for the changeover between said open position and said closed position of the gripper legs (11, 12) and having at least one sliding part (18) which is movable back and forth in a translatory manner when the actuating device is moved back and forth in a translatory manner and which acts on said at least at least one gripper leg (11, 12) to subject the latter to a force in a direction toward said open position during a translatory movement of the sliding part (18) in one direction (A) and in a direction toward said closed position during a translatory movement of the sliding part (18) in the opposite direction (B).

13. A gripper according to claim 5, characterized in that the elongate flat surface has one or two noses (20) which extends or extend merely along a border part of the associated gripper leg (11, 12).

14. A gripper according to claim 2, characterized in that said sliding part has at least one closing element (19) by which a closing movement of an associated gripper leg (11, 12) is produced and said two gripper legs mounted to pivot relative to one another pivot about a pivot axis and the side of the closing element (19) which is directed toward a gripper leg (11, 12) is designed as an elongate flat surface which extends at least partially along the width of the gripper leg (11, 12) and parallel to the pivot axis of the gripper leg (11, 12).

15. A conveying apparatus according to claim 12 wherein said grippers further comprise:

said sliding part has a spreading element (20) by means of which, in order to produce an opening movement of at least of one gripper leg (11, 12), a flat inner side of said gripper leg (11, 12) which is directed toward the respectively other gripper leg (12, 11), can be subjected to the action of force.

* * * * *